US007210769B2

(12) United States Patent
Yasoshima

(10) Patent No.: US 7,210,769 B2
(45) Date of Patent: May 1, 2007

(54) LIQUID JET HEAD AND LIQUID JET APPARATUS

(75) Inventor: Takeshi Yasoshima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 281 days.

(21) Appl. No.: 10/992,113

(22) Filed: Nov. 19, 2004

(65) Prior Publication Data

US 2005/0134654 A1 Jun. 23, 2005

(30) Foreign Application Priority Data

Nov. 20, 2003 (JP) ..... 2003-390825

(51) Int. Cl.
*B41J 2/045* (2006.01)

(52) U.S. Cl. ..... 347/70; 347/68

(58) Field of Classification Search ..... 347/68, 347/70–72; 310/311, 323.06, 365
See application file for complete search history.

(56) References Cited

U.S. PATENT DOCUMENTS

2003/0218657 A1* 11/2003 Miyata ..... 347/68

FOREIGN PATENT DOCUMENTS

JP 2002-225290 A 8/2002

* cited by examiner

*Primary Examiner*—Stephen Meier
*Assistant Examiner*—Lisa M. Solomon
(74) *Attorney, Agent, or Firm*—Sughrue Mion, PLLC

(57) ABSTRACT

A liquid jet head includes a passage-forming substrate including pressure generating chambers communicating with nozzle orifices, and piezoelectric elements provided on one side of the passage-forming substrate, with a vibration plate between the elements and the plate. The piezoelectric elements include lower and upper electrodes, and a piezoelectric layer. In the liquid jet head, pressure generating chambers are arranged in a width direction. The lower electrode is continuously provided from a region facing the pressure generating chambers to a region facing compartment walls. The liquid jet head includes a lead electrode for lower electrode, which is drawn out from the lower electrode in the region facing the compartment walls, and which includes a first lead electrode, having a width equivalent to or narrower than that of the compartment wall, and a second lead electrode formed on the first lead electrode and wider than the first lead electrode.

7 Claims, 8 Drawing Sheets

LIQUID JET HEAD AND LIQUID JET APPARATUS

BACKGROUND OF THE INVENTION

1. Field of the Invention

The present invention relates to a liquid jet head and a liquid jet apparatus, and more particularly, to an inkjet recording head and an inkjet recording apparatus, in which a part of pressure generating chambers which communicate with nozzle orifices ejecting ink droplets is formed of a vibration plate, piezoelectric elements are formed on a surface of this vibration plate, and the ink droplets are ejected by displacement of the piezoelectric elements.

2. Description of the Related Art

In an inkjet recording head, a part of pressure generating chambers communicating with nozzle orifices ejecting ink droplets is formed of a vibration plate, this vibration plate is deformed by piezoelectric elements, ink in pressure generating chambers is pressurized and thus ink droplets are ejected from nozzle orifices. There are two types of inkjet recording heads which have been put to practical use, which include: one using a piezoelectric actuator of a longitudinal vibration mode, which extends and contracts in an axial direction of a piezoelectric element; and one using a piezoelectric actuator of a flexure vibration mode.

As the one using the actuator of the flexure vibration mode, there is one, for example, in which a uniform piezoelectric material layer is formed across an entire surface of a vibration plate by use of a deposition technology, this piezoelectric material layer is cut into a shape corresponding to pressure generating chambers by use of a lithography method, and piezoelectric elements are formed so as to be independent for each of the pressure generating chambers (for example, see Patent Document 1) Moreover, the piezoelectric element used in the above-described actuator of the flexure vibration mode includes a lower electrode that is a common electrode, a piezoelectric layer formed on the lower electrode and an upper electrode that is an individual electrode formed on the piezoelectric layer.

In such a conventional inkjet recording head, the lower electrode is provided so as to be common to a plurality of piezoelectric elements. Thus, when a number of ink droplets are ejected all at once by simultaneously driving a number of piezoelectric elements, a voltage drop occurs and a displacement amount of the piezoelectric elements becomes unstable. Consequently, there arises a problem that an ink ejecting property is deteriorated. Moreover, if the piezoelectric elements are arranged densely, for example, it is required to narrow a width of wiring drawn out from the lower electrode between the piezoelectric elements. Accordingly, when the Wiring width is narrowed, wiring resistance (resistance value) is increased, thus causing such problem as described above.

Moreover, since the lower electrode formed of a thin film has a thin film thickness, the wiring resistance is increased as in the case of narrowing the wiring width. Thus, there arises a problem that the ink ejecting property is deteriorated. Note that this problem can be solved by forming the lower electrode to have a large film thickness. However, the lower electrode serves also as a vibration plate in a region facing the pressure generating chambers. Accordingly, when the film thickness of the lower electrode is increased, there arises a problem that a displacement amount of the vibration plate due to drive of the piezoelectric element is lowered. Note that, needless to say, such problems as described above similarly arise not only in the inkjet recording head ejecting ink droplets but also in other liquid jet heads ejecting liquid droplets other than ink.

[Patent Document 1]

Japanese Patent Laid-Open No. 2002-225290 (Page 5, FIGS. 1 and 2)

SUMMARY OF THE INVENTION

In consideration of the circumstances as described above, an object of the present invention is to provide a liquid jet head and a liquid jet apparatus, which can obtain a good and stable liquid ejecting property while preventing lowering of a displacement amount of a vibration plate.

A first aspect of the present invention for achieving the foregoing object is a liquid jet head which includes: a passage-forming substrate in which pressure generating chambers communicating with nozzle orifices ejecting liquids are formed; and piezoelectric elements provided on one side of the passage-forming substrate with a vibration plate interposed between the elements and the substrate, and each of the piezoelectric elements includes a lower electrode, a piezoelectric layer and an upper electrode. In the liquid jet head, a plurality of pressure generating chambers are arranged in a width direction thereof, and the lower electrode is continuously provided from a region facing the pressure generating chambers to a region facing compartment walls at both sides in the width direction of the pressure generating chambers. The liquid jet head includes a lead electrode for lower electrode, which is drawn out from the lower electrode in the region facing the compartment walls. The lead electrode for lower electrode at least includes a first lead electrode having a width which is either equivalent to or narrower than that of the compartment wall and a second lead electrode which is formed on the first lead electrode and is wider than the first lead electrode.

In the first aspect, since the second lead electrode is formed to be wider than the first lead electrode, a wiring resistance (resistance value) is surely lowered, compared to the case where the second lead electrode is formed to have the same width as that of the first lead electrode. Moreover, the width of the first lead electrode is equivalent to or narrower than that of the compartment wall, and the first lead electrode is never formed in the region facing a pressure generating chamber. Thus, lowering of a displacement amount of the vibration plate due to drive of piezoelectric elements is surely prevented.

A second aspect of the present invention is the liquid jet head according to the first aspect, characterized in that the second lead electrode is wider than the compartment wall.

In the second aspect, since the second lead electrode is wider than the compartment wall, the wiring resistance (resistance value) is surely lowered.

A third aspect of the present invention is the liquid jet head according to one of the first and second aspects, characterized in that at least the piezoelectric elements and the lead electrode for lower electrode are covered with an insulating film made of an insulating material, and a width of the second lead electrode on its upper surface side is wider than a width thereof on the first lead electrode side.

In the third aspect, since the width of the second lead electrode on the first lead electrode side is formed to be narrower than that on the upper surface side, the insulating material easily enters into a periphery of the first lead electrode. Accordingly, the periphery of the first lead electrode is surely covered with the insulating film. Thus, destruction of the piezoelectric element (the piezoelectric layer) attributable to moisture and the like is surely prevented.

A fourth aspect of the present invention is the liquid jet head according to any one of the first to third aspects, characterized in that the first lead electrode serves also as an adhesion layer made of adherent metal for closely bonding at least the lower electrode and the second lead electrode.

In the fourth aspect, adhesion at least between the lower electrode and the second lead electrode is enhanced.

A fifth aspect of the present invention is the liquid jet head according to the fourth aspect, characterized in that the first lead electrode is formed by side etching in a state where the second lead electrode is closely bonded on the first lead electrode.

In the fifth aspect, the width of the first lead electrode can be relatively easily and surely formed to be narrower than that of the second lead electrode.

A sixth aspect of the present invention is the liquid jet head according to any one of the first to fifth aspects, characterized in that the pressure generating chambers are formed in a single crystal silicon substrate by anisotropic etching and respective layers of the piezoelectric element are formed by deposition and a lithography method.

In the sixth aspect, even if the lower electrode is thinly formed, the wiring resistance is surely lowered by forming the second lead electrode to be wider than the first lead electrode drawn out from the lower electrode. Moreover, if the lower electrode is set to function as the vibration plate, the resistance value can be lowered without forming the lower electrode to be thick. Thus, lowering of the displacement amount of the vibration plate due to drive of piezoelectric elements is surely prevented.

A seventh aspect of the present invention is a liquid jet apparatus including the liquid jet head according to any one of the first to sixth aspects.

In the seventh aspect, a liquid jet apparatus with improved reliability is relatively easily realized.

DESCRIPTION OF THE EMBODIMENTS

The present invention will be described in detail below based on embodiments.

Embodiment 1

Figure 1:
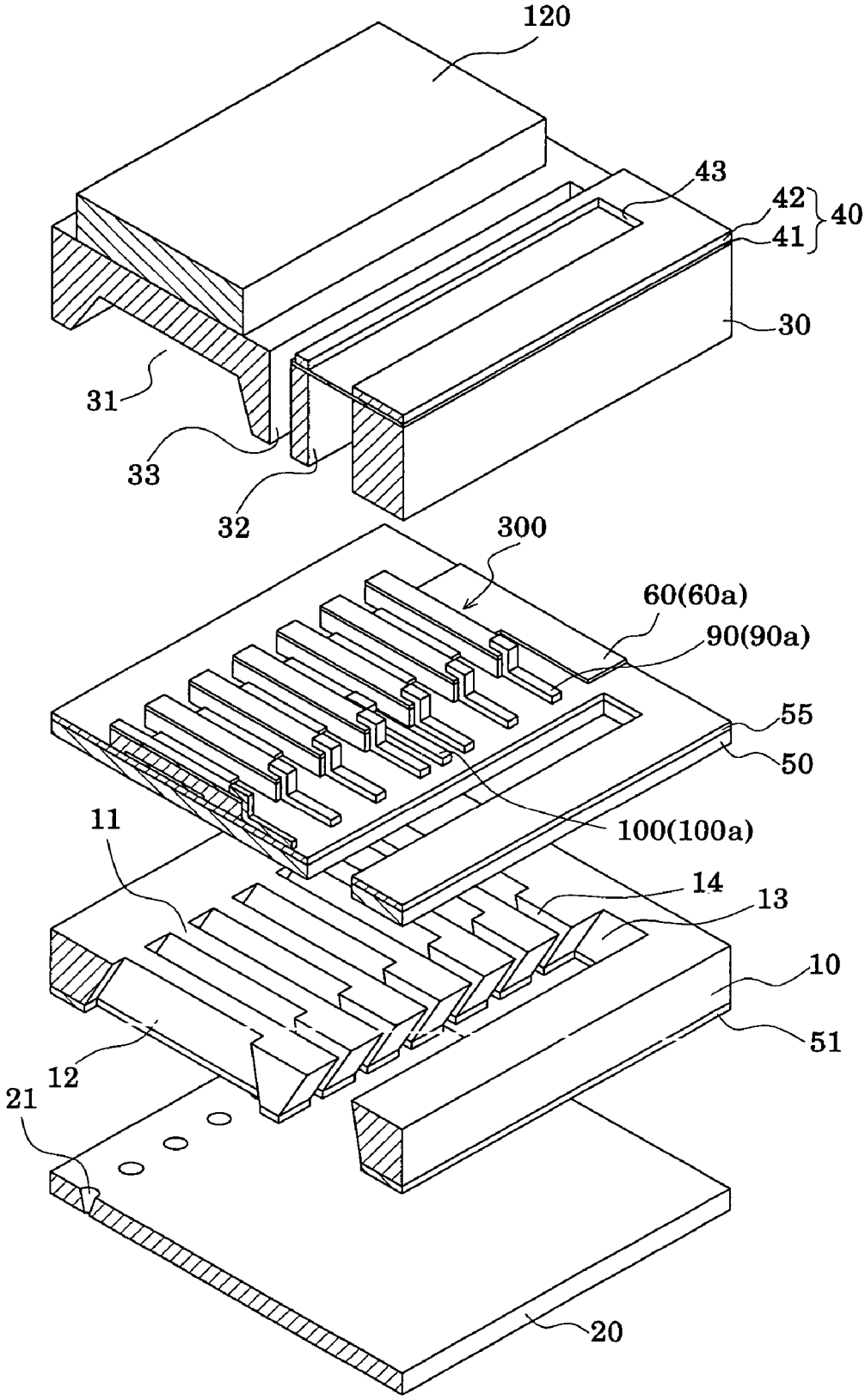
FIG. 1 is an exploded perspective view of a recording head according to Embodiment 1.
Figure 2A:
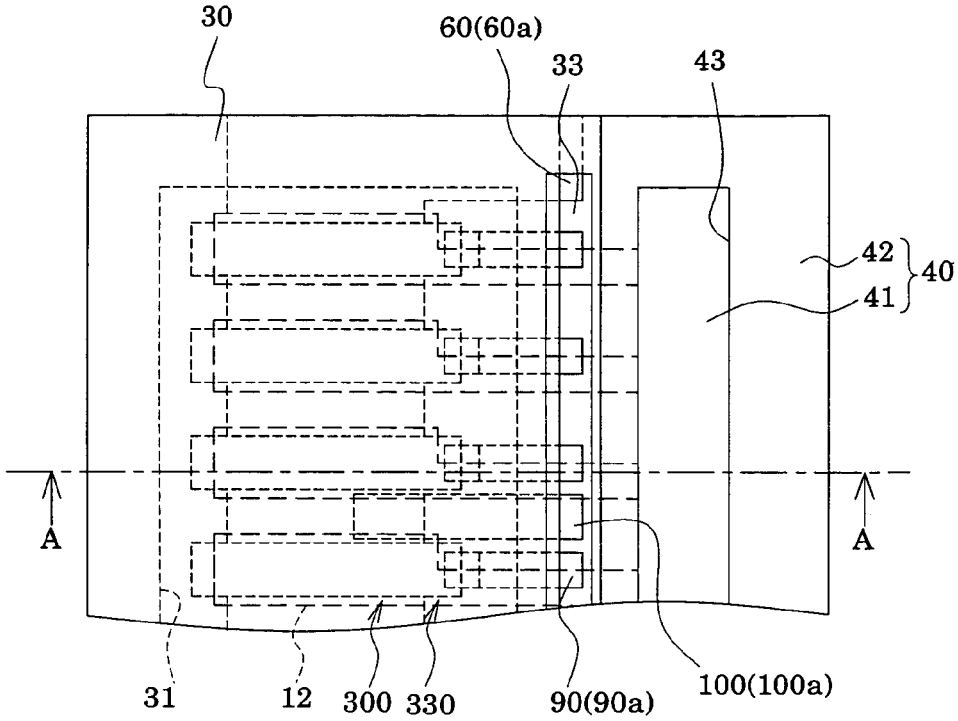
FIGS. 2(A) and 2(B) are a plan and cross-sectional view of the recording head according to Embodiment 1.
Figure 2B:
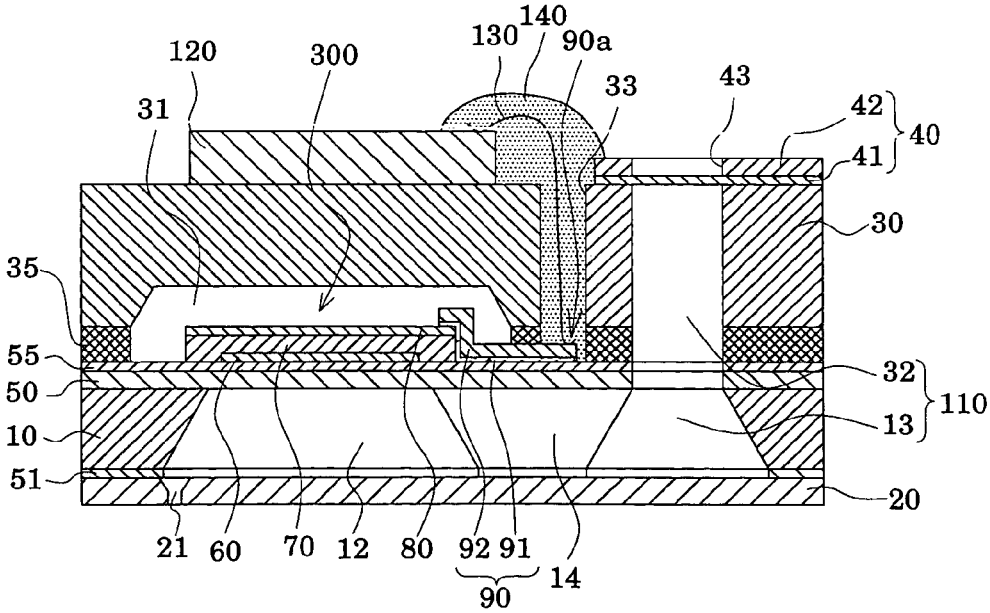

FIG. 1 is an exploded perspective view showing an inkjet recording head according to Embodiment 1 of the present invention. FIGS. 2(A) and 2(B) are a plan and cross-sectional view of FIG. 1. As shown in FIG. 1, a passage-forming substrate 10 is made of a single crystal silicon substrate of plane orientation (110) in this embodiment and, on one surface thereof, an elastic film 50 with a thickness of 1 to 2 μm, which is made of silicon dioxide previously formed by thermal oxidation, is formed. In this passage-forming substrate 10, pressure generating chambers 12 are arranged in a width direction thereof by performing anisotropic etching of the single crystal silicon substrate from the other surface thereof. Moreover, on the outside in a longitudinal direction of the pressure generating chambers 12 in the passage-forming substrate 10, a communicating portion 13 is formed, which communicates with a reservoir portion in a protective plate to be described later and constitutes a part of a reservoir to be a common ink chamber of the respective pressure generating chambers 12. The communicating portion 13 and the respective pressure generating chambers 12 are communicated with each other through ink supply paths 14, each of which is provided for each of the pressure generating chambers 12.

Here, anisotropic etching is performed by utilizing a difference in an etching rate of the single crystal silicon substrate. For example, in this embodiment, when the single crystal silicon substrate is dipped in an alkaline solution such as KOH, the substrate is gradually eroded and there appear a first plane (111) perpendicular to the plane (110) and a second plane (111) positioned at about a 70-degree angle with this first plane (111) and at about a 35-degree angle with the foregoing plane (110). Thus, the anisotropic etching is performed by utilizing a characteristic that an etching rate of the planes (111) is about 1/180 as compared with that of the plane (110). By use of the anisotropic etching, high-precision processing can be performed on the basis of a depth processing in a parallelogram shape, which is formed by two of the first planes (111) and two of the oblique second planes (111). The pressure generating chambers 12 can be arranged with high density.

In this embodiment, long sides of each pressure generating chamber 12 are formed of first planes (111) and short sides thereof are formed of second planes (111). This pressure generating chamber 12 is formed by performing etching up to the elastic film 50 while nearly penetrating the passage-forming substrate 10. Here, an extremely small part of the elastic film 50 is dipped in the alkaline solution used for etching the single crystal silicon substrate. Moreover, each of the ink supply paths 14 is formed to have a width narrower than that of a pressure generating chamber 12. Accordingly, a passage resistance of ink flowing into the pressure generating chamber 12 from the communicating portion 13 is maintained constant.

Moreover, on the open face side of the passage-forming substrate 10, a nozzle plate 20 having nozzle orifices 21 drilled therein is fixed by use of an adhesive agent, a thermowelding film or the like, with an insulating film 51 interposed therebetween. Specifically, the insulating film 51 is used as a mask in the formation of the pressure generating chambers 12, and the nozzle orifices 21 communicate with the vicinity of end portions of the pressure generating chambers 12 at the opposite side to the ink supply paths 14. Note that the nozzle plate 20 is made of glass ceramics, stainless steel, or the like having a thickness of, for example, 0.01 to 1 mm and a linear expansion coefficient of, for example, 2.5 to 4.5 [$\times 10^{-6}$/degree C.] at 300 degree C. or less.

Meanwhile, on the side opposite to the open face of the passage-forming substrate 10 as described above, the elastic film 50 having a thickness of, for example, about 1.0 μm is formed as described above. On this elastic film 50, an insulation film 55 having a thickness of, for example, about 0.4 μm is formed. Furthermore, on this insulation film 55, a lower electrode film 60 having a thickness of, for example, about 0.2 μm, a piezoelectric layer 70 having a thickness of, for example, about 1.0 μm and an upper electrode film 80 having a thickness of, for example, about 0.05 μm are laminated by a process to be described later to constitute a piezoelectric element 300. Here, the piezoelectric element 300 means a part including the lower electrode film 60, the piezoelectric layer 70 and the upper electrode film 80. In general, the piezoelectric element 300 is formed by using any one of the electrodes thereof as a common electrode and patterning the other electrode and the piezoelectric layer 70 for each of the pressure generating chambers 12. Consequently, here, a part which includes the patterned electrodes and the piezoelectric layer 70 and in which piezoelectric strain is caused by voltage application to both the electrodes is called a piezoelectric active portion. In this embodiment, the lower electrode film 60 is used as the common electrode of the piezoelectric element 300 and the upper electrode film 80 is used as an individual electrode thereof. However, there is no harm in reversing this order for convenience of a drive circuit and wiring. In either case, the piezoelectric active portion comes to be formed in each of the pressure generating chambers 12. Moreover, here, the piezoelectric element 300 and the vibration plate undergoing displacement by drive of the piezoelectric element 300 are collectively referred to as a piezoelectric actuator. Note that, in the example described above, the elastic film 50, the insulation film 55 and the lower electrode film 60 function as the vibration plate.

Figure 3A:
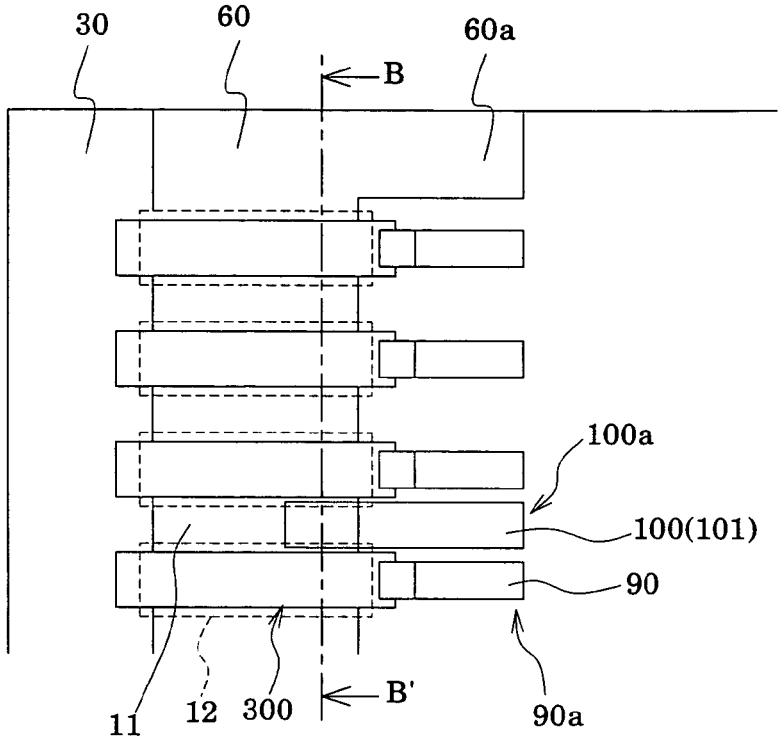
FIGS. 3(A) and 3(B) are a plan and cross-sectional view showing a main part of the recording head according to Embodiment 1.
Figure 3B:
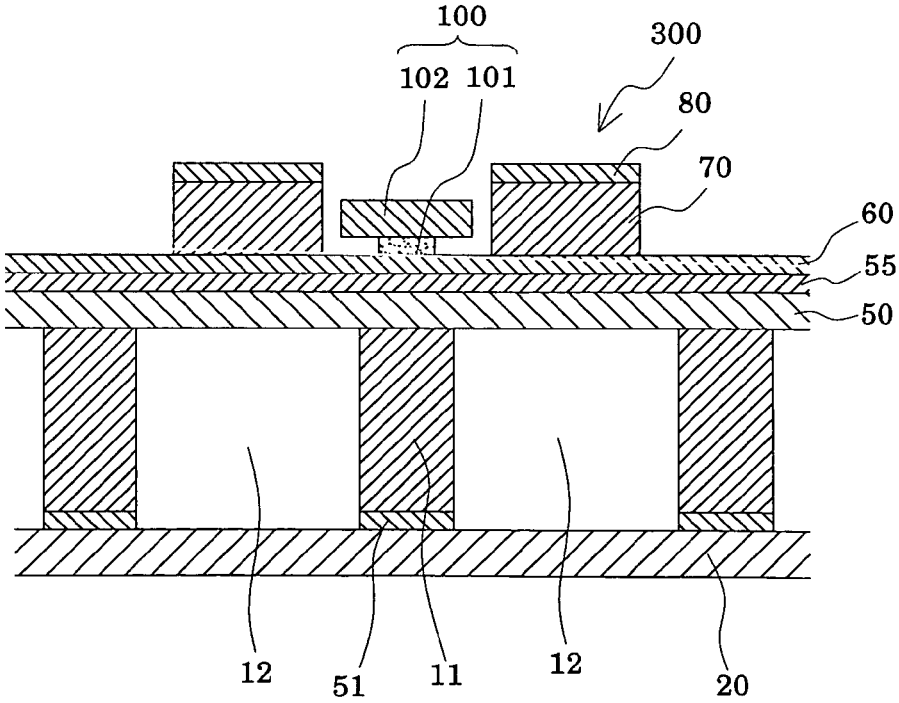

Furthermore, in this embodiment, as shown in FIGS. 2A, 3(A) and 3(B), a lead electrode for upper electrode 90 is connected in the vicinity of one end of the upper electrode film 80. In this embodiment, the lead electrode for upper electrode 90 is extended to the vicinity of the communicating portion 13 from above a piezoelectric inactive portion on the outside of the pressure generating chamber 12. A tip of the lead electrode for upper electrode 90 is set to be a connection portion 90*a* to which a connection wiring 130 is connected, as in the case of the lower electrode film 60. Meanwhile, the lower electrode film 60 is formed in a region facing a pressure generating chamber 12 in the longitudinal direction of the pressure generating chamber 12 and is continuously provided in a region corresponding to the plurality of pressure generating chambers 12. Moreover, the lower electrode film 60 is extended to the vicinity of the communicating portion 13 from the outside of the array of the pressure generating chambers 12. A tip of the lower electrode film 60 is set to be a connection portion 60*a* to which the connection wiring 130 is connected, the connection wiring 130 being extended from a drive IC 120 to be described later. Furthermore, a lead electrode for lower electrode 100 to be electrically connected to the lower electrode film 60 is extended from a space between the piezoelectric elements 300 in which the lower electrode film 60 is provided. A tip of this lead electrode for lower electrode 100 is set to be a connection portion 100*a* with the connection wiring 130.

The lead electrode for lower electrode 100 is provided in a region facing compartment walls 11 and includes: a first lead electrode 101 which is made of, for example, adherent metal such as titanium tungsten (TiW) and has one end extended to a region facing the ink supply path 14; and a second lead electrode 102 which is formed on the first lead electrode 101 and is made of, for example, gold (Au). The first lead electrode 101 as described above serves as an adhesion layer for closely bonding the second lead electrode 102 and the insulation film 55 or the like.

In this embodiment, as shown in FIG. 3(B), the first lead electrode 101 is formed to have a width narrower than that of each of the compartment walls 11 at both sides in the width direction of the pressure generating chamber 12. Moreover, the second lead electrode 102 is formed to be wider than the first lead electrode 101 and, in this embodiment, to be wider than the width of the compartment wall 11. Thus, although the second lead electrode 102 protrudes into the region facing the pressure generating chamber 12, the second lead electrode 102 is formed to be closely bonded only on the first lead electrode 101. Thus, the second lead electrode 102 does not come into contact with the vibration plate, and has absolutely no effect on the vibration plate. Consequently, by forming the second lead electrode 102 to be wide, a wiring resistance can be lowered and reduction in a displacement amount of the vibration plate can be prevented. Therefore, a good and stable ink ejecting property can be obtained. Moreover, since the second lead electrode 102 can be formed so as not to come into contact with the vibration plate as described above, the thickness of the second lead electrode may be increased so as to further lower the wiring resistance.

Furthermore, in this embodiment, when the first lead electrode 101 is formed to have the width narrower than that of the compartment wall 11, there is also an effect in-that a positional shift of the first lead electrode 101 in a width direction can be tolerated to some extent in the region facing the compartment wall 11.

Note that, in this embodiment, the second lead electrode 102 is formed to be wider than the compartment wall 11. However, needless to say, without being limited thereto, the second lead electrode may be narrower than the compartment wall 11 as long as the second lead electrode is wider than the first lead electrode. This is because, the wiring resistance can be surely lowered, at least compared to the case where the second lead electrode 102 has the same width as that of the first lead electrode 101.

Moreover, on the surface of the passage-forming substrate 10 at the piezoelectric element 300 side, the protective plate 30 is bonded by use of an adhesive agent 35. Specifically, the protective plate 30 has a piezoelectric element holding portion 31 capable of securing a space without interfering with movement of the piezoelectric element 300 in a region facing the piezoelectric element 300. Since the piezoelectric element 300 is formed inside this piezoelectric element holding portion 31, the piezoelectric element 300 is protected in a state of being hardly influenced by the external environment. Furthermore, in the protective plate 30, the reservoir portion 32 is provided in a region corresponding to the communicating portion 13 in the passage-forming substrate 10. In this embodiment, this reservoir portion 32 is provided along the arrangement direction of the pressure generating chambers 12 while penetrating the protective plate 30 in its thickness direction. As described above, the reservoir portion 32 constitutes the reservoir 110 to be the common ink chamber of the respective pressure generating chambers 12 by communicating with the communicating portion 13 in the passage-forming substrate 10.

Moreover, in a region between the piezoelectric element holding portion 31 and the reservoir portion 32 in the protective plate 30, a through-hole 33 is provided, which penetrates the protective plate 30 in its thickness direction. Inside this through-hole 33, the connection portion 60*a* of the lower electrode film 60, the connection portion 90*a* of the lead electrode for upper electrode 90 and the connection portion 100*a* of the lead electrode for lower electrode 100, all of which are described above, are exposed. Accordingly, to these connection portions 60*a*, 90*a* and 100*a*, one end of the connection wiring 130 extended from the drive IC 120 mounted on the protective plate 30 is connected. The through-hole 33, in which the connection wiring 130 described above is extended, is filled with a sealer 140 that is an organic insulating material, for example, a potting material in this embodiment. The connection portion 60*a* of the lower electrode film 60, the connection portion 90*a* of the lead electrode for upper electrode 90, the connection portion 100*a* of the lead electrode for lower electrode 100 and the connection wiring 130 are completely covered with the sealer 140.

Note that, as a material of the protective plate 30, for example, glass, a ceramic material, metal, resin and the like are cited. However, it is more preferable that the protective plate 30 is formed of a material having approximately the same thermal expansion coefficient as that of the passage-forming substrate 10. In this embodiment, the protective plate 30 is formed by use of a single crystal silicon substrate, which is the same material as that of the passage-forming substrate 10.

Moreover, on the protective plate 30, a compliance plate 40 including a sealing film 41 and a fixing plate 42 is bonded. The sealing film 41 is made of a material having low stiffness and flexibility (for example, a polyphenylene sulfide (PPS) film with a thickness of 6 μm) and this sealing film 41 seals one side of the reservoir portion 32. Moreover, the fixing plate 42 is formed by use of a hard material such as metal (for example, stainless-steel (SUS) with a thickness of 30 μm or the like). A region of this fixing plate 42, the region corresponding to the reservoir 110, is set to be an opening portion 43 which is obtained by entirely removing the fixing plate 42 in the region in its thickness direction. Thus, one side of the reservoir 110 is sealed only by the sealing film 41 having flexibility.

The inkjet recording head of this embodiment as described above takes in ink from unillustrated external ink supply means and fills the inside thereof from the reservoir 110 to the nozzle orifices 21 with ink. Thereafter, in accordance with a recording signal from the drive IC 120, a voltage is applied between the respective lower and upper electrode films 60 and 80 which correspond to the respective pressure generating chambers 12. Subsequently, the elastic film 50, the insulation film 55, the lower electrode film 60 and the piezoelectric layer 70 undergo flexible deformations. Thus, pressures in the respective pressure generating chambers 12 are increased and ink droplets are ejected the nozzle orifices 21.

Figure 4A:
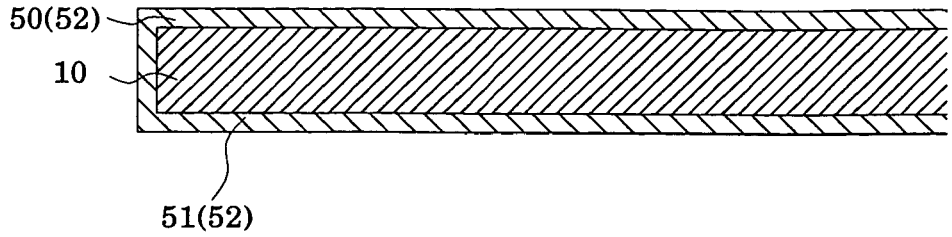
FIGS. 4(A) to 4(D) are cross-sectional views showing steps of manufacturing the recording head according to Embodiment 1.
Figure 4B:
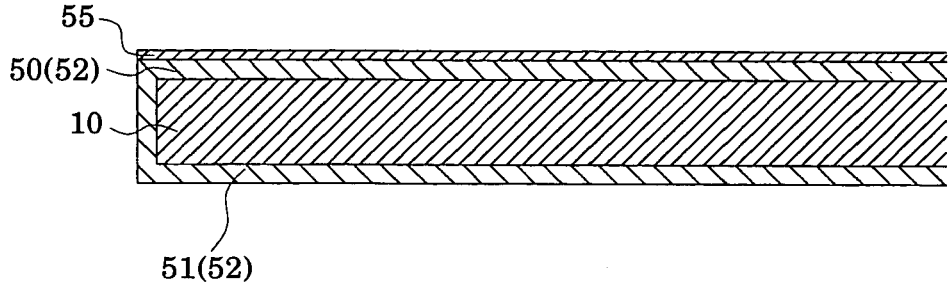
Figure 4C:
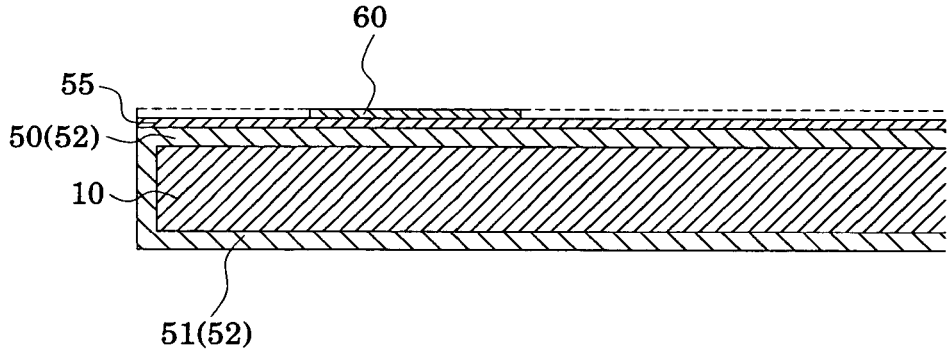
Figure 4D:
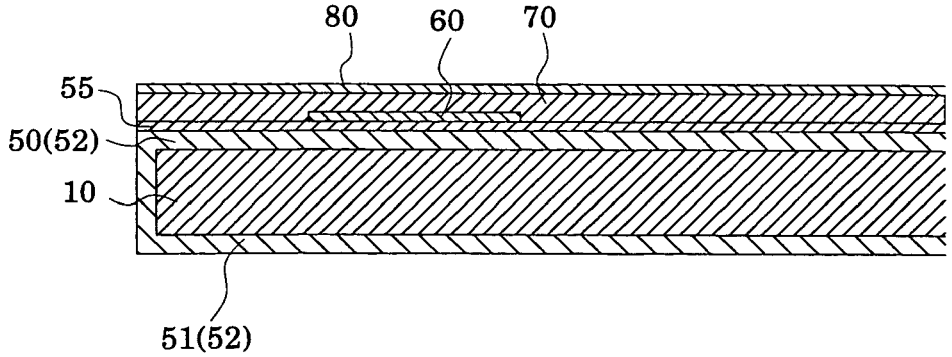

Here, with reference to FIGS. 4(A) to 4(D), FIGS. 5(A) to 5(D) and FIG. 6, a method for manufacturing such an inkjet recording head will be described. Note that FIGS. 4(A) to 4(D) and FIGS. 5(A) to 5(C) are cross-sectional views in the longitudinal direction of the pressure generating chamber. Moreover, FIG. 6 is a cross-sectional view in the width direction of the pressure generating chamber. First, as shown in FIG. 4(A), a passage-forming substrate 10 that is a single crystal silicon substrate is thermally oxidized in a diffusion furnace heated to about 1100 degree C. Thus, a silicon dioxide film 52 to form an elastic film 50 and mask film 51 is formed all over the passage-forming substrate 10. Next, as shown in FIG. 4(B), on the elastic film 50 (the silicon dioxide film 52), an insulation film 55 is formed, which is made of zirconium oxide ($ZrO_2$) obtained by thermally-oxidizing a zirconium (Zr) layer formed on the elastic film in a diffusion furnace heated to about 500 to 1200 degree C., for example. Next, as shown in FIG. 4(C), after a lower electrode film 60 is formed by laminating platinum and iridium, for example, on the insulation film 55, this lower electrode film 60 is patterned to have a predetermined shape. Next, as shown in FIG. 4(D) a piezoelectric layer 70 made of, for example, lead zirconate titanate (PZT) or the like and an upper electrode film 80 made of, for example, iridium are formed on the entire surface of the passage-forming substrate 10.

Figure 5A:
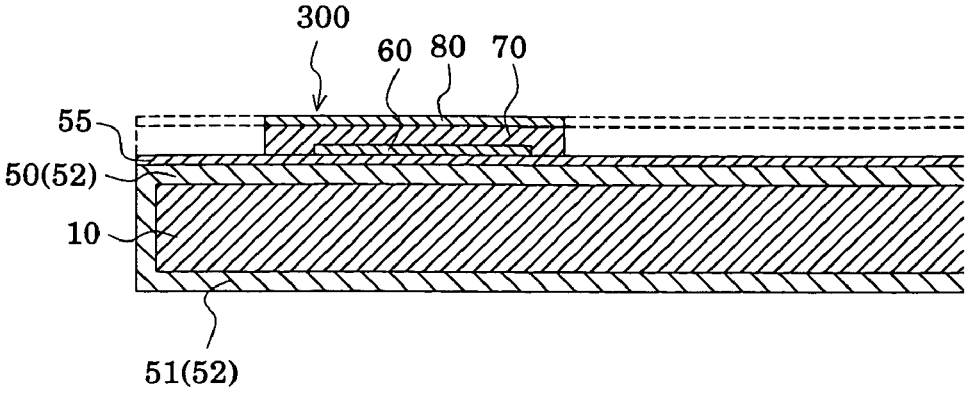
FIGS. 5(A) to 5(C) are cross-sectional views showing steps of manufacturing the recording head according to Embodiment 1.
Figure 5B:
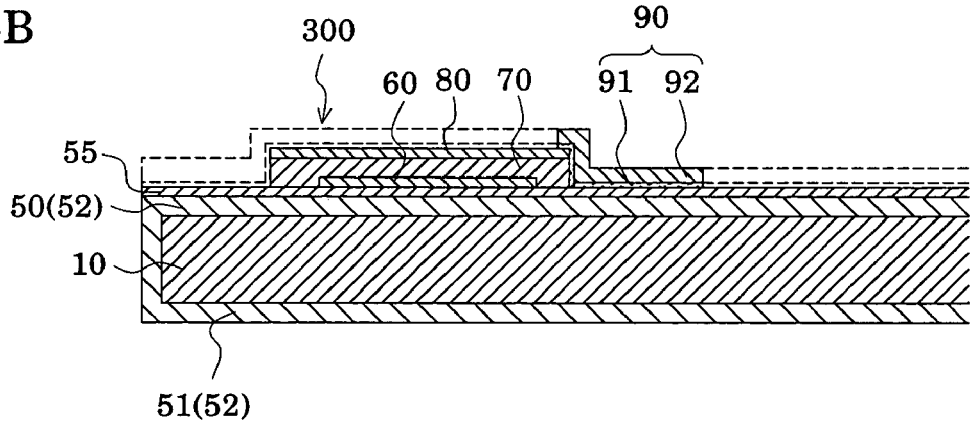
Figure 5C:
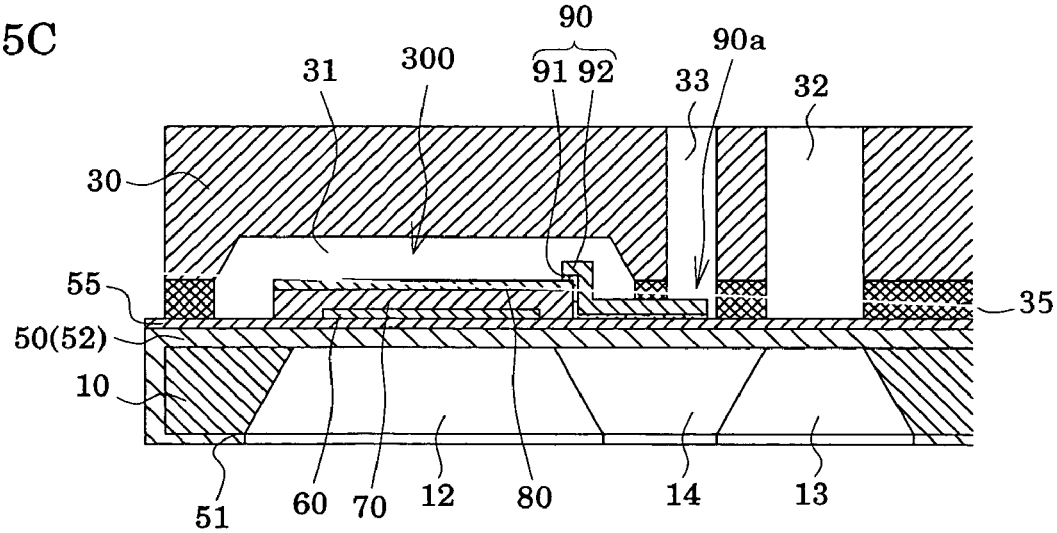
Figure 6:
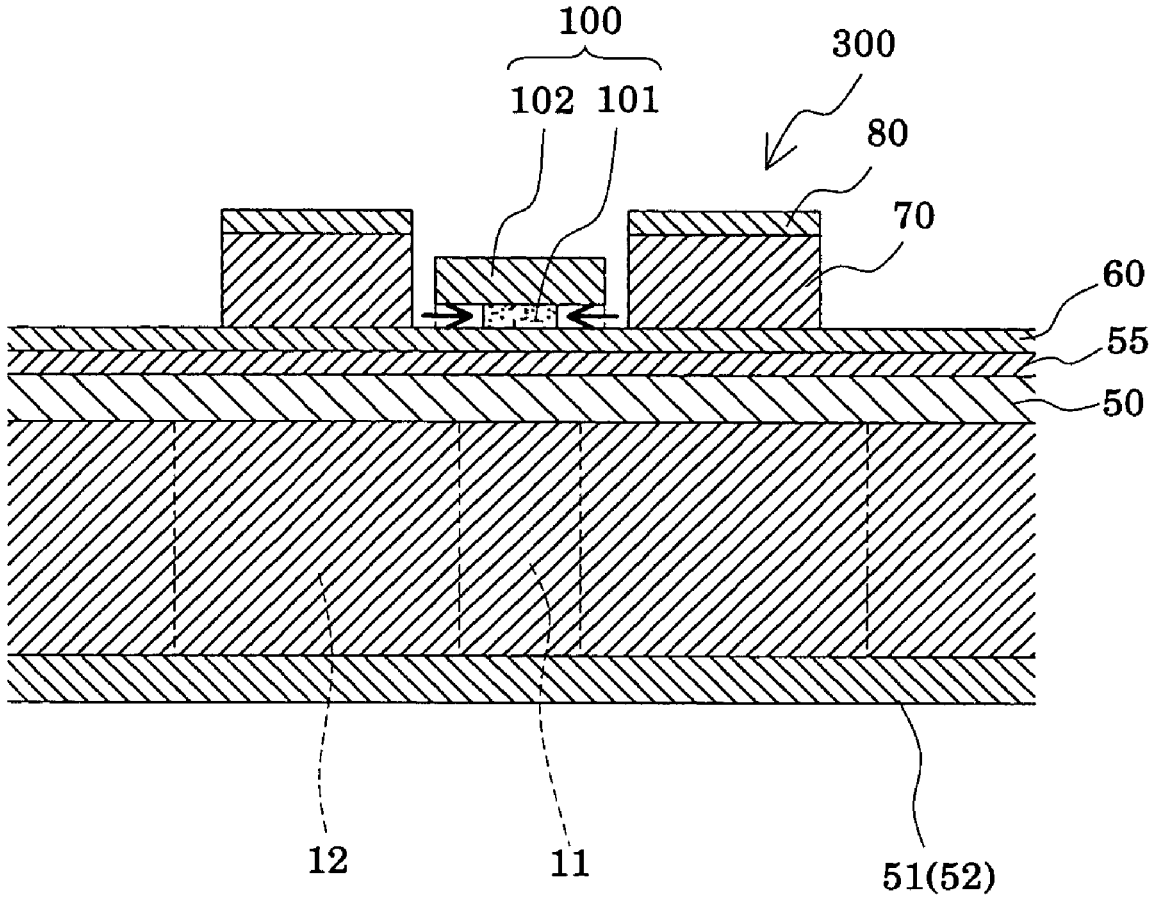
FIG. 6 is a cross-sectional view showing a step of manufacturing the recording head according to Embodiment 1.

Subsequently, as shown in FIG. 5(A), the piezoelectric layer 70 and the upper electrode film 80 are patterned in a region facing each of the pressure generating chambers 12, thus forming a piezoelectric element 300. Next, a lead electrode for upper electrode 90 and a lead electrode for lower electrode 100 are formed. To be more specific, as shown in FIG. 5(B) and FIG. 6, a first metal film made of adherent metal, for example, titanium tungsten (TiW) is formed on the entire surface of the passage-forming substrate 10. Thereafter, on the entire surface of the first metal film, a second metal film made of, for example, gold (Au) or the like is formed. Subsequently, for example, by means of a mask pattern (not shown) which is made of resist or the like, the second metal film is etched by using a potassium iodide solution and patterned into a predetermined shape for each of the piezoelectric elements 300 and a predetermined shape in the lower electrode film 60 between the piezoelectric elements 300 provided thereon. Furthermore, by means of the same mask pattern, the first metal film is etched by using a hydrogen peroxide solution and patterned into a predetermined shape. Thus, the lead electrode for upper electrode 90 including a first and second lead electrode 91 and 92, and the lead electrode for lower electrode 100 including a first and second lead electrode 101 and 102 are formed. In this embodiment, in etching of the first metal film, the first metal film is side-etched (over-etched) to form the first lead electrodes 91 and 101 to be narrower than the second lead electrodes 92 and 102. In this event, the first metal film is side-etched in a state of being closely bonded to the second metal film in the middle of the width direction. Note that this side-etching is performed by controlling an etching time. Next, as shown in FIG. 5(C), a protective plate 30 is bonded to the piezoelectric element 300 side of the passage-forming substrate 10 by use of an adhesive agent 35, and the passage-forming substrate 10 is subjected to anisotropic etching by means of the mask film 51 patterned into a predetermined shape. Thus, the pressure generating chamber 12 and the like are formed.

Note that, in practice, a number of chips are simultaneously formed on a piece of wafer by performing the above-described series of film formation and anisotropic etching. After the above-described process is completed, the wafer is divided into chip-size pieces for each passage-forming substrate 10 as shown in FIG. 1. Thereafter, a nozzle plate 20 is bonded to the passage-forming substrate 10 with the mask film 51 interposed therebetween, a drive IC 120 is mounted on the protective plate 30 and a compliance plate 40 is bonded to the protective plate 30. Furthermore, a connection wiring 130 is formed between the drive IC 120 and the connection portions 60*a* and 90*a* of the lower electrode film 60 and the lead electrode for upper electrode 90. Thereafter, these connection portions 60*a* and 90*a* and the connection wiring 130 are covered with a sealer 140. Thus, the inkjet recording head of this embodiment is obtained.

(Embodiment 2)

Figure 7:
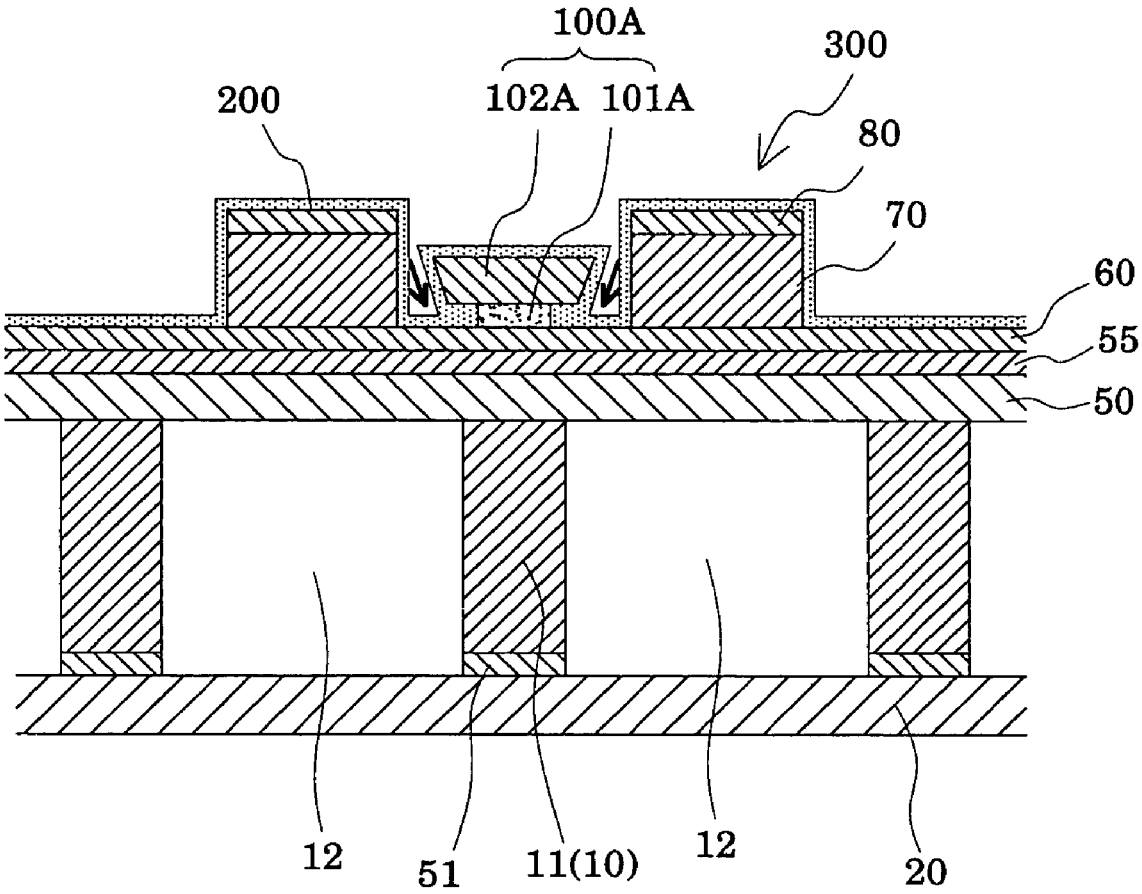
FIG. 7 is a cross-sectional view showing a main part of a recording head according to Embodiment 2.

FIG. 7 is a cross-sectional view showing a main part of an inkjet recording head according to Embodiment 2 of the present invention. In this embodiment, as shown in FIG. 7, a lead electrode for lower electrode 100A and a piezoelectric element 300 are covered with an insulating film 200 made of aluminum oxide, for example, so as to prevent destruction of the piezoelectric element 300 attributable to moisture. This embodiment is similar to Embodiment 1 except that a second lead electrode 102A of the lead electrode for lower electrode 100A is formed to become narrower toward a first lead electrode 101A.

Here, the insulating film 200 provided to cover the piezoelectric element 300 is formed, for example, by use of a CVD method or the like. Thus, it is difficult to form the insulating film 200 around the lead electrode for lower electrode 100A having the second lead electrode 102A wider than the first lead electrode 101A. However, as in the case of this embodiment, when the second lead electrode 102A is formed to become narrower toward the first lead electrode 101A, an insulating material easily enters into a periphery of the first lead electrode 101A and the insulating film 200 is formed well also in a periphery of the lead electrode for lower electrode 100A. Thus, the piezoelectric element 300 can be surely covered with the insulating film 200 and destruction of the piezoelectric element 300 (a piezoelectric layer 70) attributable to moisture and the like can be surely prevented. Moreover, it is needless to say that the configuration as described above can obtain the same effects as those of Embodiment 1.

(Other Embodiments)

Figure 8:
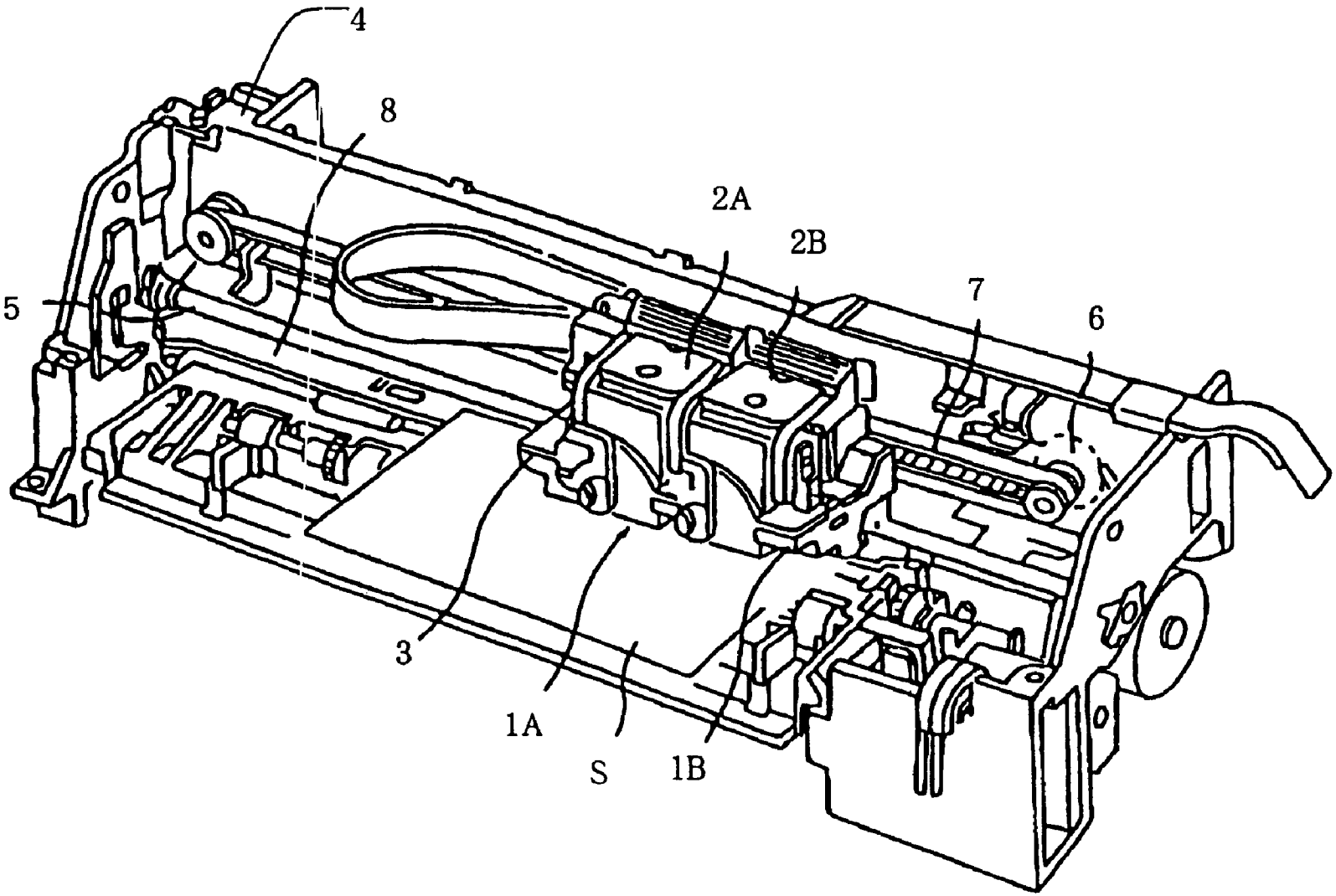
FIG. 8 is a schematic view of a recording apparatus according to an embodiment.

Although the respective embodiments of the present invention have been described above, the present invention is not limited to the embodiments described above. For example, in Embodiment 1 described above, the first lead electrode 101 is formed to be narrower than the compartment wall 11. However, without being limited thereto, the first lead electrode may be formed to have the same width as that of the compartment wall. Moreover, in Embodiment 1 described above, the description was given by exemplifying the lead electrode for lower electrode 100 with a two-layer structure including the first and second lead electrodes 101 and 102. However, without being limited thereto, the lead electrode for lower electrode may have a structure with three layers or more. Note that the inkjet recording head of the embodiments described above constitutes a part of a recording head unit including an ink passage communicating with an ink cartridge and the like and is mounted on an inkjet recording apparatus. FIG. 8 is a schematic view showing an example of the inkjet recording apparatus. As shown in FIG. 8, in recording head units 1A and 1B having inkjet recording heads, cartridges 2A and 2B included in ink supply means are detachably provided. A carriage 3 having these recording head units 1A and 1B mounted thereon is movably provided in an axial direction on a carriage shaft 5 attached to an apparatus main body 4. These recording head units 1A and 1B are, for example, ones which eject a black ink composition and a color ink composition, respectively. Drive force of a drive motor 6 is transmitted to the carriage 3 via a plurality of unillustrated gears and a timing belt 7. Thus, the carriage 3 having the recording head units 1A and 1B mounted thereon is moved along the carriage shaft 5. Meanwhile, a platen 8 is provided along the carriage shaft 5 in the apparatus main body 4, and a recording sheet S that is a recording medium such as paper fed by an unillustrated feed roller or the like is carried on the platen 8.

Moreover, in the above-described embodiments, the inkjet recording heads were described as an example of the liquid jet head of the present invention. However, basic configurations of a liquid jet head are not limited to the one described above. The present invention is aimed widely at general liquid jet heads and, needless to say, can also be applied to ones ejecting liquids other than ink. As the other liquid jet heads, cited are, for example: various kinds of recording heads used in an image recording apparatus such as a printer; a coloring material jet head used for manufacturing color filters of a liquid crystal display and the like; an electrode material jet head used for forming electrodes of an organic EL display, a field emission display (FED) and the like; a bio-organic matter jet head used for manufacturing biochips; and the like.

What is claimed is:

1. A liquid jet head including a passage-forming substrate in which pressure generating chambers communicating with nozzle orifices ejecting liquids are formed, and piezoelectric elements being provided on one side of the passage-forming substrate with a vibration plate interposed between the elements and the substrate, each of the piezoelectric elements including a lower electrode, a piezoelectric layer and an upper electrode, the liquid jet head comprising:

a lead electrode for lower electrode, which is drawn out from the lower electrode in a region facing compartment walls at both sides in a width direction of the pressure generating chambers, wherein a plurality of pressure generating chambers are arranged in the width direction thereof, the lower electrode is continuously provided from a region facing the pressure generating chambers to the region facing the compartment walls, and the lead electrode for lower electrode at least includes a first lead electrode having a width which is either equivalent to or narrower than that of the compartment wall and a second lead electrode which is formed on the first lead electrode and is wider than the first lead electrode.

2. The liquid jet head according to claim 1, wherein the second lead electrode is wider than the compartment wall.

3. The liquid jet head according to claim 1, wherein at least the piezoelectric elements and the lead electrode for lower electrode are covered with an insulating film made of an insulating material, and a width of the second lead electrode on its upper surface side is wider than a width thereof on the first lead electrode side.

4. The liquid jet head according to claim 1, wherein the first lead electrode serves also as an adhesion layer made of adherent metal for closely bonding at least the lower electrode and the second lead electrode.

5. The liquid jet head according to claim 4, wherein the first lead electrode is formed by side etching in a state where the second lead electrode is closely bonded on the first lead electrode.

6. The liquid jet head according to claim 1, wherein the pressure generating chambers are formed in a single crystal silicon substrate by anisotropic etching and respective layers of the piezoelectric element are formed by deposition and a lithography method.

7. A liquid jet apparatus comprising the liquid jet head according to any one of claims 1 to 6.

* * * * *